United States Patent [19]

Westman

[11] Patent Number: 4,998,331

[45] Date of Patent: Mar. 12, 1991

[54] APPARATUS FOR REMOVING UNUSED THREAD FROM A SPOOL

[75] Inventor: Jan E. Westman, Solvesborg, Sweden

[73] Assignee: Ingersoll-Rand Company, Woodcliff Lake, N.J.

[21] Appl. No.: 457,107

[22] Filed: Dec. 26, 1989

[51] Int. Cl.[5] ..... B65H 73/00

[52] U.S. Cl. ..... 28/295

[58] Field of Search ..... 28/295, 296, 298

[56] References Cited

FOREIGN PATENT DOCUMENTS 151255 8/1961 U.S.S.R. ..... 28/295

*Primary Examiner*—Werner H. Schroeder
*Assistant Examiner*—Bradley Kurtz DeSandro
*Attorney, Agent, or Firm*—James R. Bell

[57] ABSTRACT

Unused thread is automatically removed from a spool by a device which holds the spool in position for a thread cutting operation. A clamping device is provided to maintain the unused thread on the spool during the cutting operation. A cutting device is movable into engagement with the thread and movable axially along the spool for cutting the unused thread. The clamping device is then actuated to release the cut thread and permit the same to separate from the spool.

15 Claims, 5 Drawing Sheets

11
POSITION A
POSITION B
POSITION C
POSITION D
16
16A
16B
16C
16D
18
20A
20B
20C
20D

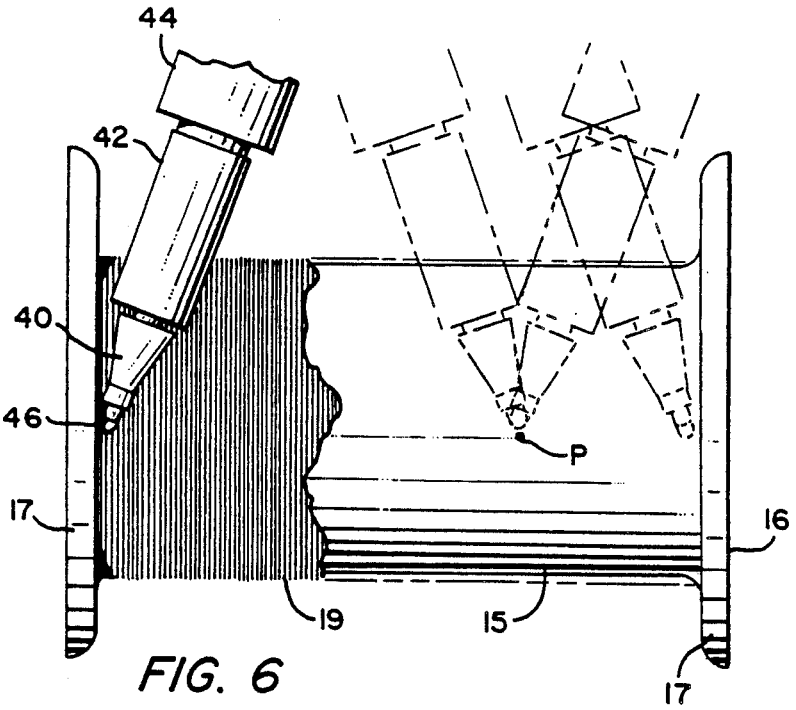
FIG. 6
FIG. 7
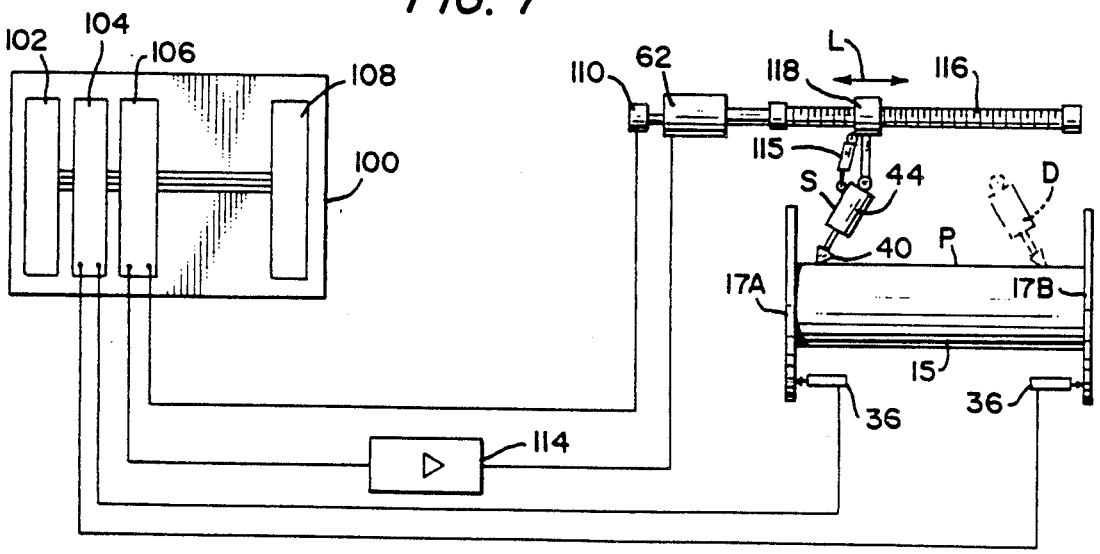

APPARATUS FOR REMOVING UNUSED THREAD FROM A SPOOL

BACKGROUND OF THE INVENTION

This invention relates generally to cutting and more particularly to removing unused thread from a spool.

Nylon and other types of thread are commonly used in the production of carpet. The thread is supplied to carpet making machinery from large spools. Substantially all of the thread is used from the spool, however, a small portion of unused thread still remains on the spool at the time it is replaced by another spool which contains a replenished supply of thread. Since these spools are to be rewound with a replenished supply of thread, the small portion of unused thread must be removed from the spool before the spool can be rewound.

Removal of the unused thread must be accomplished with the least amount of damage to the spools so as to prolong re-use of the spools. It is difficult to avoid damaging the spools since cutting devices are commonly used to remove the thread from the spools. Accomplishing the thread removal automatically by the use of machinery is preferable but it is difficult since through re-use, the spools gradually change shape and therefore the machinery must be adaptable to the changing shapes.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus for removing unused thread from a spool including means for holding the spool in position for a cutting operation. A clamping device is provided to maintain the unused thread on the spool during the cutting operation. A cutting device is movable into engagement with the thread and movable axially along the spool for cutting the unused thread. The clamping means is then actuated to release and permit the cut thread to separate from the spool.

The foregoing and other aspects will become apparent from the following detailed description of the invention when considered in conjunction with the accompanying drawing figures. It is to be expressly understood, however, that the drawing figures are not intended as a definition of the invention but are for the purpose of illustration only.

BRIEF DESCRIPTION OF THE DRAWING FIGURES

In the drawing:

FIG. 6 is a detailed view illustrating an embodiment of the cutting device of the present invention; and FIG. 7 is a schematic view illustrating an embodiment of a control system for controlling the cutting operation of the present invention.

DETAILED DESCRIPTION

Figure 1:
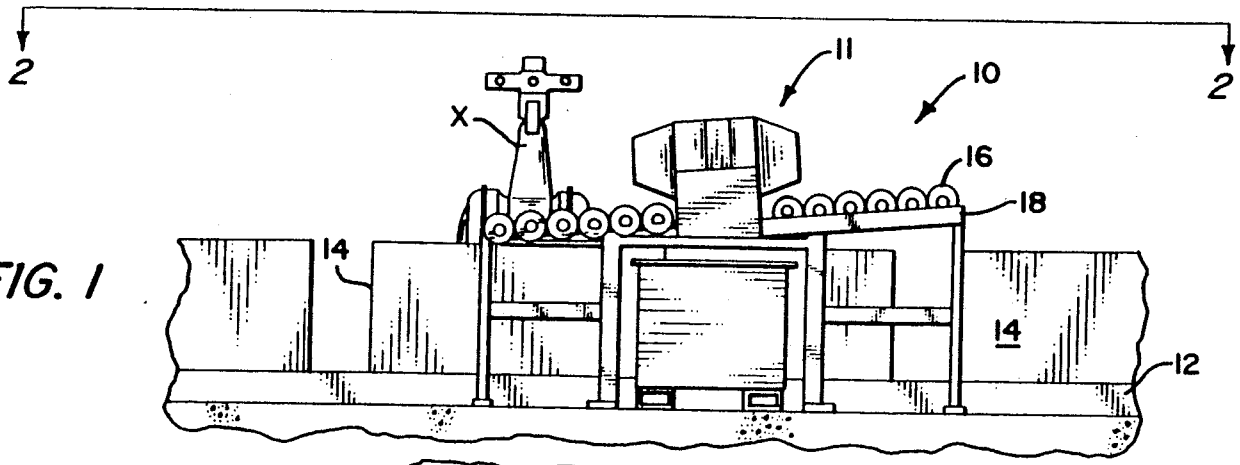
FIG. 1 is a side view illustrating an embodiment of the work station of the present invention.
Figure 2:
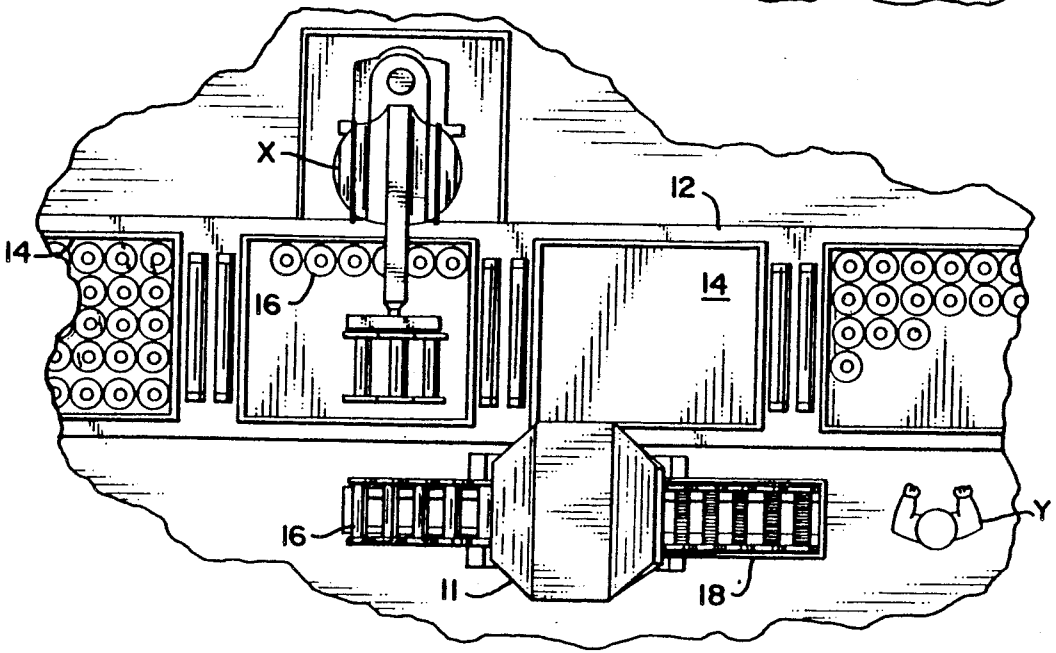
FIG. 2 is a top view taken along the line 2—2 of FIG. 1.

An apparatus for removing unused thread from a spool is generally designated 10 in FIGS. 1 and 2. Apparatus 10 includes a conveyor 12 for conveying boxes 14 containing spools 16 having left-over thread thereon. Spools 16 include spaced apart flanges 17, interconnected by a core 15 (best illustrated in FIG. 6). Spools 16 are removed from boxes 14 either mechanically or manually, and placed on a sloping feed table 18. Feed table 18 feeds spool 16 through a work station 11 where the unused thread 19 is removed. After the thread is removed, the now empty spools 16 are placed back into boxes 14, either mechanically or manually as indicated at positions X and Y, respectively.

Figure 3:
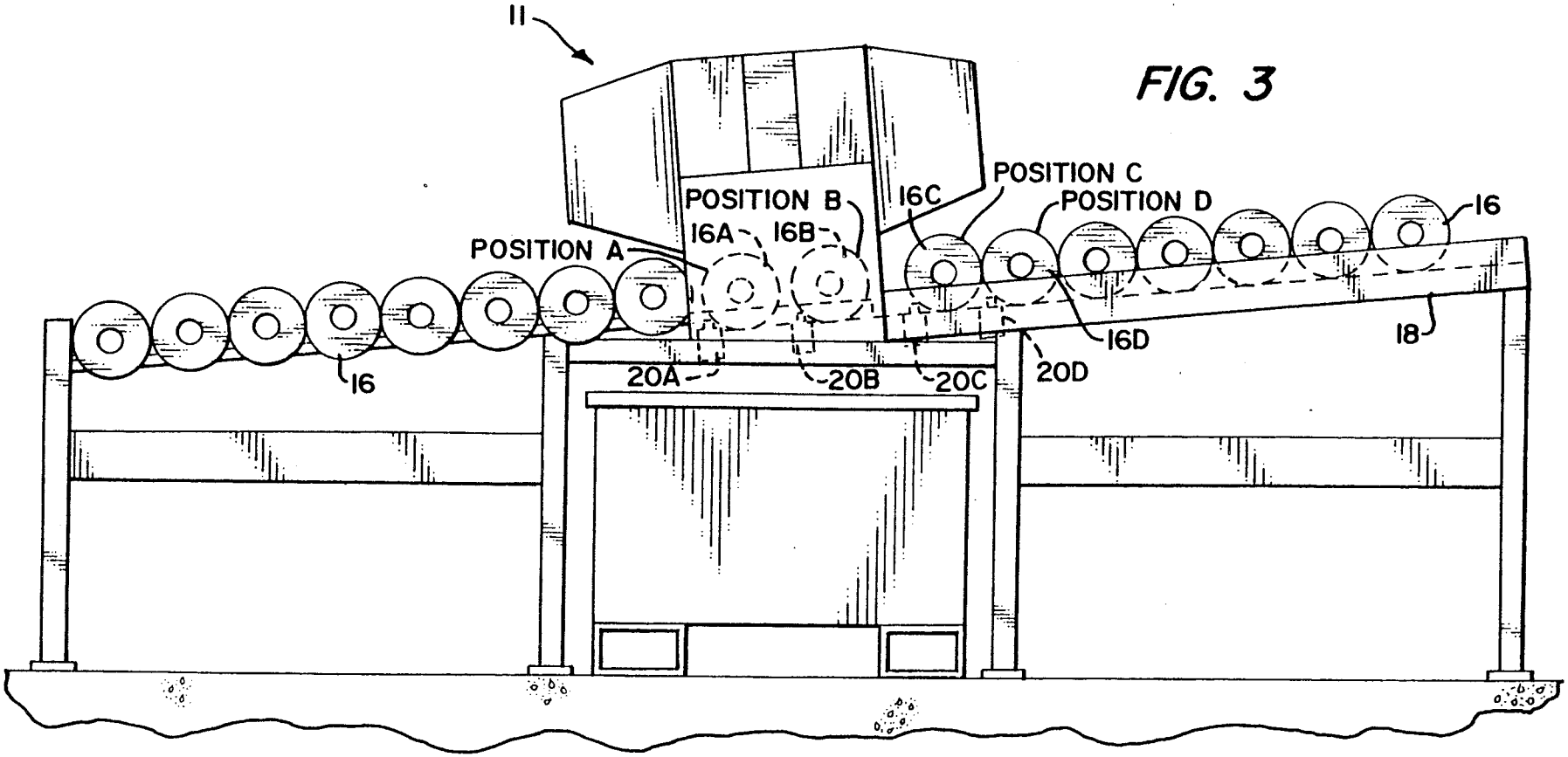
FIG. 3 is an enlarged side view illustrating an embodiment of the work station of the present invention.

In FIG. 3, a plurality of extendible and retractable stops 20A, 20B, 20C and 20D, sequentially function to automatically index a plurality of spools 16A, 16B, 16C and 16D into position for removal of the unused thread. For example, stops 20A and 20B retract, spools 16A and 16B roll out of work station 11 and are returned to boxes 14. Stop 20A extends and stop 20C retracts to permit spool 16C to move from a position C to a position A. Stop 20C extends and stop 20D retracts permitting spool 16D to move from position D to position C. Stops 20B and 20D extend and stop 20C retracts to permit spool 16D to move from position C to position B. Stop 20D retracts and stop 20C extends to permit new spools to move to positions C and D, and the process continues.

The thread removal operation is simultaneously performed on two spools which requires dual sets of parts. However, to simplify the discussion only the operation on one spool will be described in detail.

Figure 4:
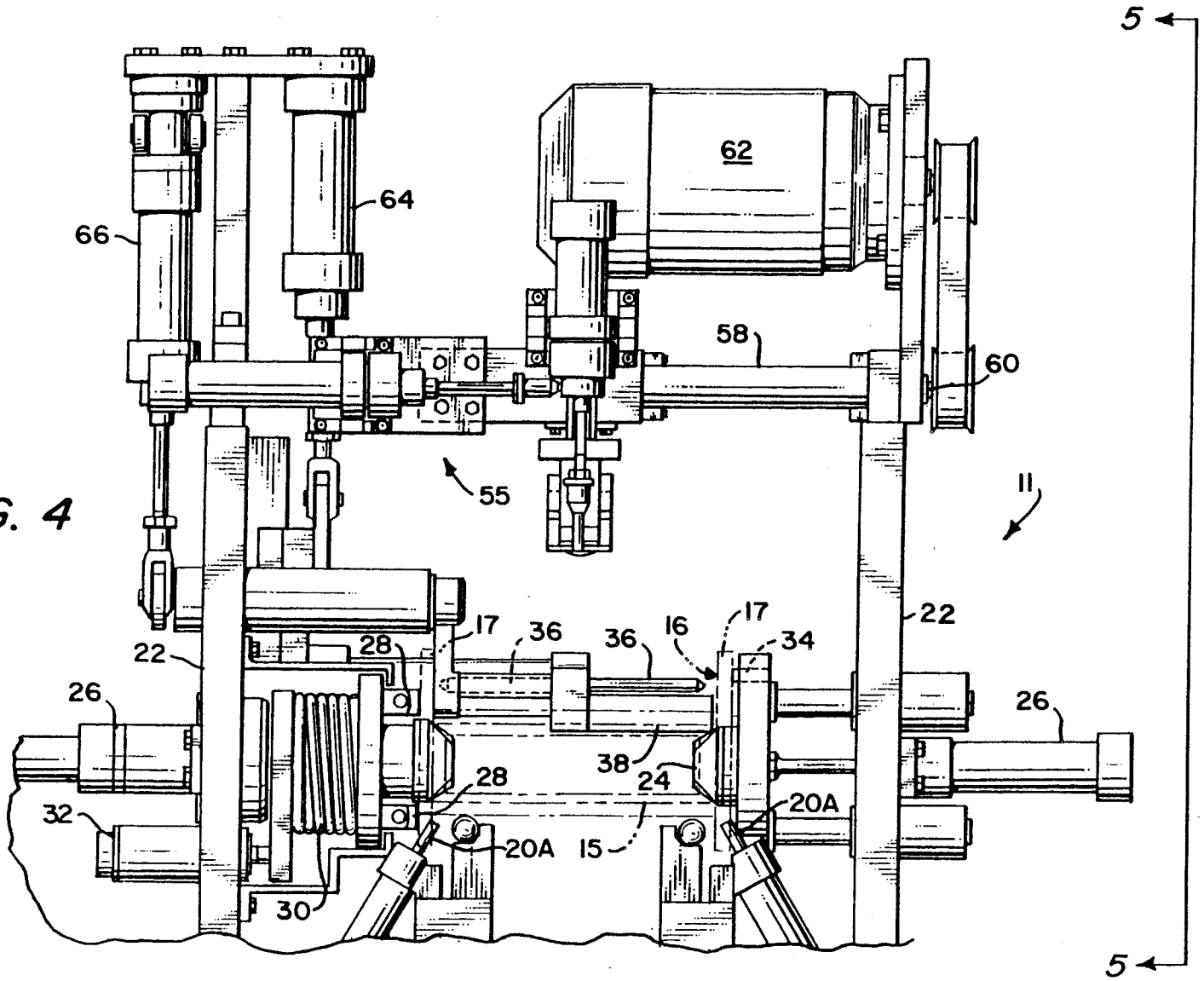
FIG. 4 is a detailed view illustrating an embodiment of the work station of the present invention.
Figure 5:
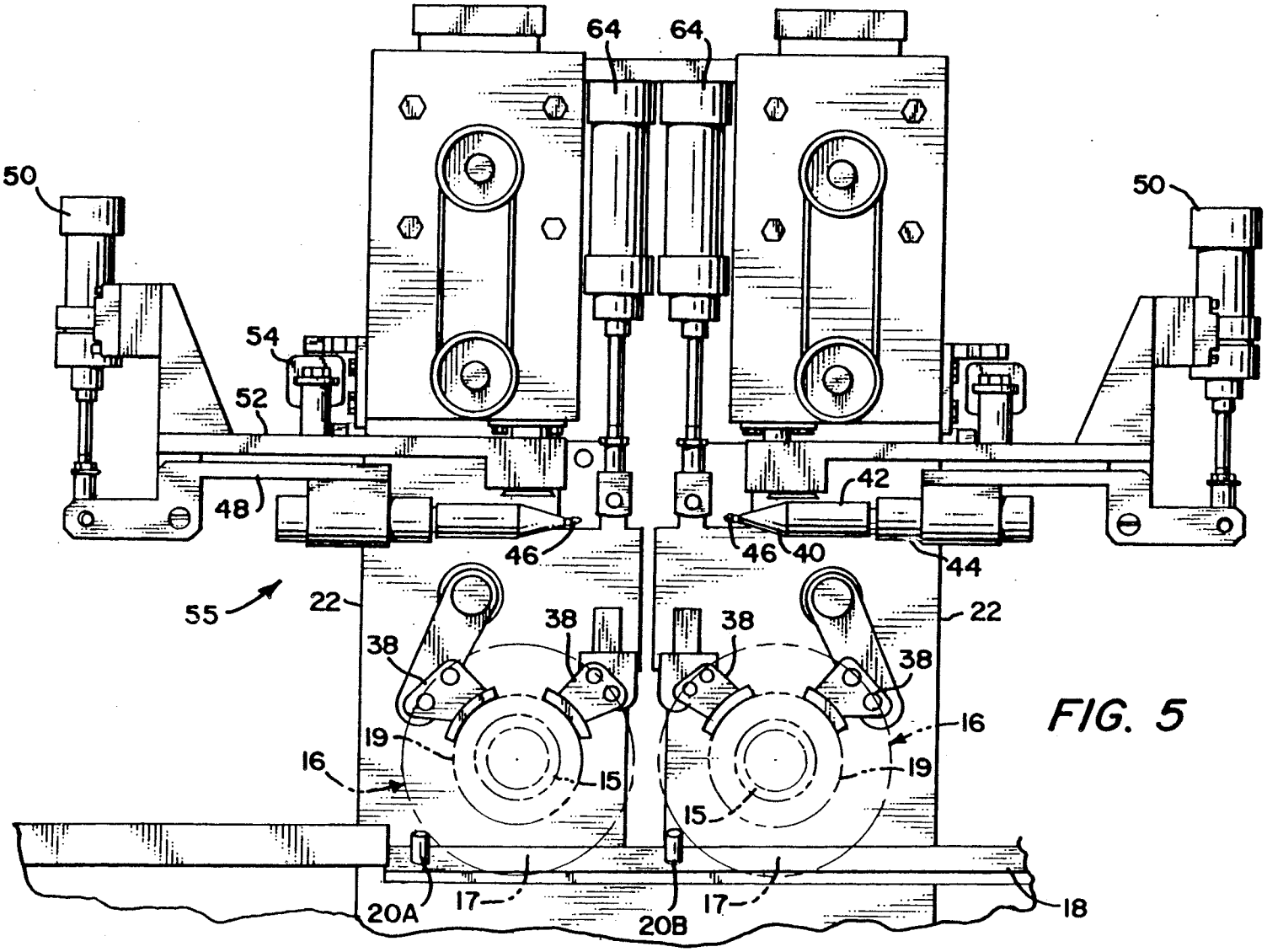
FIG. 5 is a view taken along the line 5—5 of FIG. 4.

Workstation 11 is mounted on a suitable frame 22, see FIGS. 4 and 5. A pair of opposed locating devices, each designated 24, adjacent flanges 17, extend via cylinders 26 into core 15 to retain spool 16 in a non-rotating position for a thread cutting operation. A pair of clamps, each designated 38, are actuated by suitable cylinders 64, 66, to engage the unused thread on core 15 of spool 16. A suitable cylinder 50 is actuated to pivot a cutter 40 to a position adjacent the unused thread. A pair of sensors, each designated 36, extend to locate the position of flanges 17, since through re-use, the size of spools 16 may change slightly. Information from sensors 36 is fed to an information processing device discussed below in detail.

A cutting unit 55, includes cutter 40 powered to rotate by a motor 44 acting through a shaft 42. Cutter 40 is conical and includes a cutting tip 46 which is preferably conical for limiting the unused thread 19 from wrapping around the rotating cutter 40. Cutter 40 is mounted on an arm 48 also operated by cylinder 50. Arm 48 is also mounted on another arm 52 which is pivotally actuated by an appropriate cylinder 54.

A suitable motor 62 functions through a ball-screw device 60 to move cutting unit 55 along a shaft 58, to a cutting position adjacent one flange 17; the cutting position being derived from state-of-the-art devices processing the information from one of the sensors 36, discussed in more detail below. Cylinder 50 functions to pivot arm 48 until cutting tip 46 touches the core 15 of spool 16 and simultaneously, the thread 19 begins to be cut. Motor 62 moves cutting unit 55 so that cutter 40 moves along the length of core 15 of spool 16 which forms a cut through thread 19. At an appropriate position, due to the information accumulated by sensors 36, and due to the number of rotations of motor 62 related to a programmed value, cutter 40 pivots (see FIG. 6) as it moves along the length of core 15 so that cutting tip 46 can move to a position adjacent the other flange 17 as located by the other of the sensors 36. In this manner the thread !9 is completely cut along core 15. Cutter 40 can now be pivoted away from spool 16 and moved to a position awaiting the next thread cutting operation upon the arrival of another spool.

This is further illustrated by referring to FIG. 7, wherein the above-described state-of-the-art devices comprise a cutting system including a programmable controller 100, a CPU 102, analog input modules 104, a positioning module 106, and digital input/output modules 108. Controller 100 is electronically interconnected with sensors 36, an encoder 110 and servo motor 62 via a servo amplifier 114.

Servo motor 62 rotates a screw 116. Such rotation causes linear movement, as indicated by a directional arrow designated L, of a follower 118 connected to cutter motor 44. Also, a tilt cylinder 115 is interconnected with cutter motor 44 and follower 118. The position of sensors 36 in relation to screw 116 is known by calibration. As such, a measured position of the flanges 17, via sensors 36, is stored in the controller 100 which signals servo motor 62 to rotate screw 116 a certain number of rotations based upon the position of a first one of the flanges designated 17*a*. When cutter 40 has moved across spool core 15 to a position designated P, for example, controller 100 signals tilt cylinder 115 to pivot cutter 40 from a solid line position S to a dotted position D. Servo motor 62 moves cutter 40 to a second one of the flanges 17*b*. Controller 100 signals servo motor 62 to stop when cutter 40 is adjacent flange 17*b*.

Simultaneous with the above-described cutting operation, another suitable motor 32 functions to rotate abrasive scrapers 28, which are urged against a face of one of the flanges 17 by a resilient means such as a spring 30, for the purpose of removing a label from the flange face. A retainer or stop 34 limits rotation of spool 16.

Clamps 38 are actuated by cylinders 64, 66 so as to release, which permits the cut thread 19 to fall from spool core 15 due to gravity. Locating devices 24 retract to release spool 16 which is subsequently released by the appropriate stops, e.g. 20A, 20B, and returned to boxes 14 as aforesaid.

While this invention has been illustrated and described in accordance with a preferred embodiment, it is recognized that other variations and changes may be made therein without departing from the invention as set forth in the claims.

What is claimed is:

1. Apparatus for removing unused thread from a spool, comprising:

means for holding the spool in position for a thread cutting operation, the spool having a pair of spaced apart flanges interconnected by a core and the means for holding the spool including a pair of opposed locators which protrude into the core adjacent the flanges;

clamping means for clamping the unused thread on the spool during the cutting operation; and cutting means movable into engagement with the thread and movable axially along the spool for cutting the unused thread, whereby the clamping means is actuated to release and permit the cut thread to separate from the spool.

2. The apparatus as defined in claim 1, further comprising:

retainer means for limiting rotation of the spool during holding thereof.

3. The apparatus as defined in claim 1, further comprising:

means resiliently urged for rotating in abrasive engagement with one of the flanges for removing a label therefrom.

4. The apparatus as defined in claim 1, wherein the cutting means includes a rotatable cutting head and a rotatable cutting tip.

5. The apparatus as defined in claim 4, wherein the cutting tip is means for limiting wrapping of the cut thread therearound during the cutting operation.

6. The apparatus as defined in claim 4, wherein both the cutting head and the cutting tip are of a substantially conical shape.

7. The apparatus as defined in claim 1, wherein the cutting means engages the core of the spool and moves axially along the core between the flanges during the cutting operation.

8. The apparatus as defined in claim 7, wherein the cutting means is pivoted adjacent one of the flanges during a first portion of the axial movement along the core, the cutting means being pivoted adjacent the other of the flanges during a second portion of the axial movement along the core.

9. The apparatus as defined in claimed 1, further comprising:

means for sensing location of the flanges.

10. The apparatus as defined in claim 9, wherein pivoting of the cutting means is in response to information processed by the means for sensing location of the flanges.

11. Apparatus for removing unused thread from a spool, comprising:

conveyor means for conveying spools;

a feed table;

means for removing a spool from the conveyor means and placing the spool on the feed table;

stop means for indexing the spool into a position on the feed table for a thread cutting operation;

means for holding the spool in position for the thread cutting operation;

clamping means for clamping the unused thread on the spool during the thread cutting operation; and cutting means movable into engagement with the thread and movable axially along the spool for cutting the unused thread, whereby the clamping means is actuated to release and permit the cut thread to separate from the spool.

12. The apparatus as defined in claim 11, wherein the spool has a pair of spaced apart flanges interconnected by a core and the means for holding the spool includes a pair of opposed locators which protrude into the core adjacent the flanges.

13. The apparatus as defined in claim 12, wherein the cutting means engages the core of the spool and moves axially along the core between the flanges during the cutting operation.

14. The apparatus as defined in claim 13, wherein the cutting means is pivoted adjacent one of the flanges during a first portion of the axial movement along the core, the cutting means being pivoted adjacent the other of the flanges during a second portion of the axial movement along the core.

15. Apparatus for removing unused thread from a spool, comprising:

means for holding the spool in position for a thread cutting operation, the spool having a core, and the means for holding the spool including a pair of opposed locators which protrude into the core;

clamping means for clamping the unused thread on the spool during the cutting operation; and cutting means movable into engagement with the thread and movable axially along the spool for cutting the unused thread, whereby the clamping means is actuated to release and permit the cut thread to separate from the spool.

* * * * *